US009243465B2

(12) United States Patent
Lajesic

(10) Patent No.: US 9,243,465 B2
(45) **Date of Patent: *Jan. 26, 2016**

(54) DEFLECTOR ASSEMBLY FOR A LATERAL WELLBORE

(71) Applicant: Halliburton Energy Services, Inc., Houston, TX (US)

(72) Inventor: Borisa Lajesic, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

This patent is subject to a terminal disclaimer.

(21) Appl. No.: 14/358,845

(22) PCT Filed: Jul. 25, 2013

(86) PCT No.: PCT/US2013/052068

§ 371 (c)(1),
(2) Date: May 16, 2014

(87) PCT Pub. No.: WO2015/012843

PCT Pub. Date: Jan. 29, 2015

(65) Prior Publication Data

US 2015/0285016 A1 Oct. 8, 2015

(51) Int. Cl.

| | |
|---|---|
| ***E21B 23/00*** | (2006.01) |
| ***E21B 23/12*** | (2006.01) |
| ***E21B 41/00*** | (2006.01) |
| ***E21B 17/20*** | (2006.01) |

(52) U.S. Cl.
CPC ..... *E21B 23/002* (2013.01); *E21B 17/20* (2013.01); *E21B 41/0035* (2013.01)

(58) Field of Classification Search
CPC ..... E21B 41/0035; E21B 23/002
See application file for complete search history.

(56) References Cited

U.S. PATENT DOCUMENTS

| | | | | |
|---|---|---|---|---|
| 4,606,410 | A * | 8/1986 | Becker et al. | 166/313 |
| 5,732,773 | A * | 3/1998 | Parks et al. | 166/117.5 |
| 5,845,707 | A | 12/1998 | Longbottom | |
| 6,158,513 | A * | 12/2000 | Nistor et al. | 166/313 |
| 6,364,014 | B1 * | 4/2002 | Bussear | 166/242.3 |

(Continued)

FOREIGN PATENT DOCUMENTS

WO 2015012843 A1 1/2015

OTHER PUBLICATIONS

International Search Report and Written Opinion for PCT/US2013/052068 dated Apr. 23, 2014.

*Primary Examiner* — Giovanna C Wright
(74) *Attorney, Agent, or Firm* — McDermott Will & Emery LLP; Scott Brown

(57) ABSTRACT

A multi-deflector assembly for guiding a bullnose assembly into a selected borehole within a wellbore includes an upper deflector arranged within a main bore of a wellbore and defining first and second channels that extend longitudinally through the upper deflector, wherein the second channel exhibits a width greater than that of the first channel. A lower deflector is arranged within the main bore and spaced from the upper deflector by a predetermined distance. The lower deflector defines a first conduit that communicates with a lower portion of the main bore and a second conduit that communicates with a lateral bore. The upper and lower deflectors are configured to direct a bullnose assembly into one of the lateral bore and the lower portion of the main bore based on a length of a bullnose tip of the bullnose assembly as compared to the predetermined distance.

19 Claims, 6 Drawing Sheets

(56) References Cited

U.S. PATENT DOCUMENTS 6,729,410 B2 5/2004 Steele
9,140,082 B2 * 9/2015 Lajesic ..... E21B 17/18
2002/0112857 A1 8/2002 Ohmer et al.
2012/0305268 A1 12/2012 Steele
2013/0175047 A1 7/2013 Steele et al.
2015/0184474 A1 * 7/2015 Lajesic

* cited by examiner

DEFLECTOR ASSEMBLY FOR A LATERAL WELLBORE

BACKGROUND

The present disclosure relates generally to a wellbore selector assembly and, more particularly, to a multi-deflector assembly for guiding a bullnose assembly into a selected borehole within a wellbore.

Hydrocarbons can be produced through relatively complex wellbores traversing a subterranean formation. Some wellbores include one or more lateral wellbores that extend at an angle from a parent or main wellbore. Such wellbores are commonly called multilateral wellbores. Various devices and downhole tools can be installed in a multilateral wellbore in order to direct assemblies towards a particular lateral wellbore. A deflector, for example, is a device that can be positioned in the main wellbore at a junction and configured to direct a bullnose assembly conveyed downhole toward a lateral wellbore. Depending on various parameters of the bullnose assembly, some deflectors also allow the bullnose assembly to remain within the main wellbore and otherwise bypass the junction without being directed into the lateral wellbore.

Accurately directing the bullnose assembly into the main wellbore or the lateral wellbore can often be a difficult undertaking. For instance, accurate selection between wellbores commonly requires that both the deflector and the bullnose assembly be correctly orientated within the well. Even with correct orientation, however, causing the bullnose assembly to be deflected or directed toward the proper bore can further be challenging since typical deflectors require a diameter reduction before being able to pass into lower portions of a stacked multilateral well system.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to a wellbore selector assembly and, more particularly, to a multi-deflector assembly for guiding a bullnose assembly into a selected borehole within a wellbore.

The disclosure describes exemplary deflector assemblies that are able to accurately deflect a bullnose assembly into either a main wellbore or a lateral wellbore based on a length of the bullnose assembly. More particularly, the deflector assemblies have upper and lower deflectors that are separated by a predetermined distance and have channels and conduits of predetermined sizes. Depending on its length, the bullnose assembly may interact with the upper and lower deflectors and be deflected into a lateral wellbore or remain within the main wellbore and continue downhole. The disclosed embodiments may prove advantageous for well operators in being able to accurately access particular lateral wellbores by running downhole bullnose assemblies of known parameters.

Figure 1:
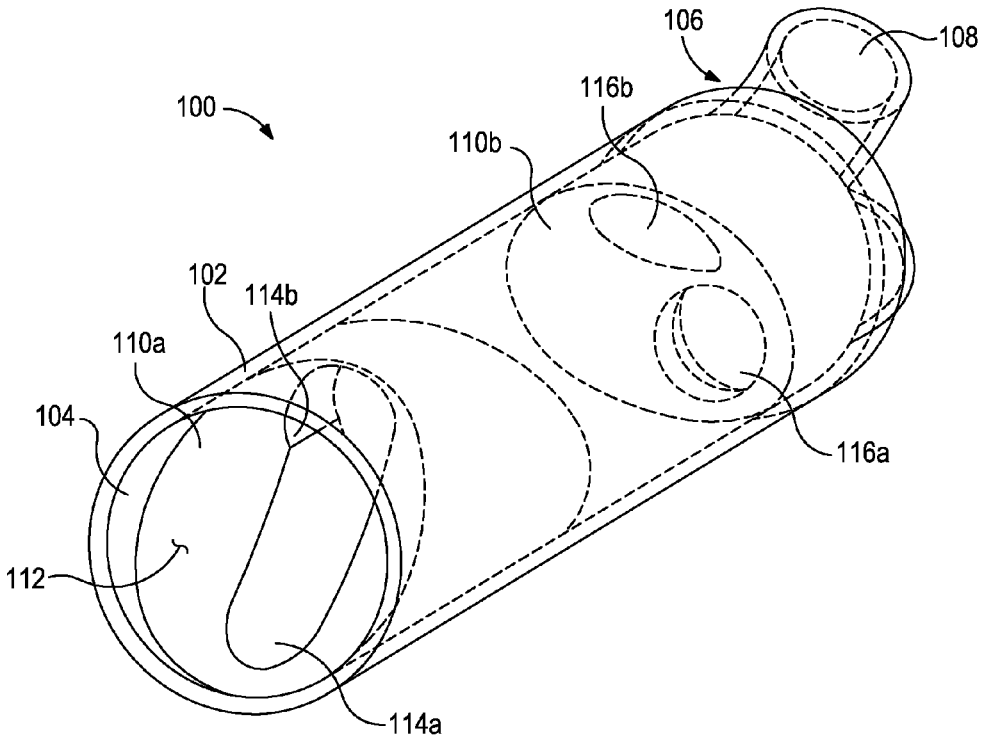
FIG. 1 depicts an isometric view of an exemplary deflector assembly, according to one or more embodiments of the disclosure.
Figure 2:
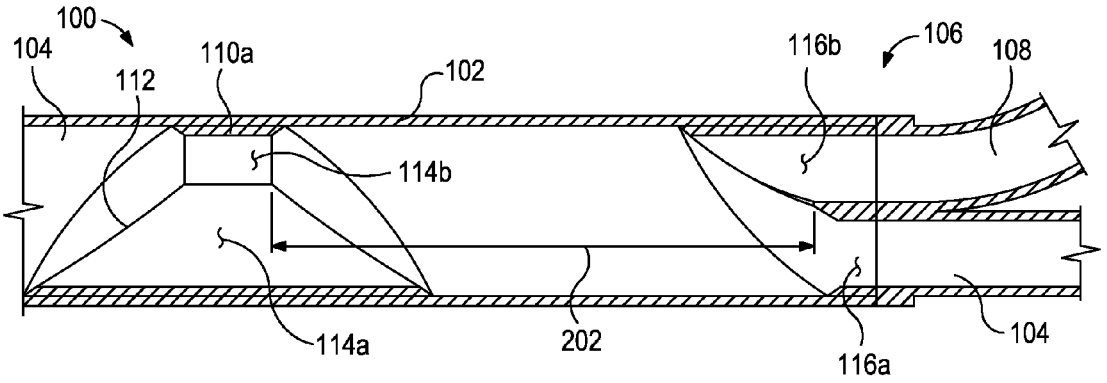
FIG. 2 depicts a cross-sectional side view of the deflector assembly of FIG. 1.

Referring to FIGS. 1 and 2, illustrated are isometric and cross-sectional side views, respectively, of an exemplary deflector assembly 100, according to one or more embodiments of the disclosure. As illustrated, the deflector assembly 100 may be arranged within or otherwise form an integral part of a tubular string 102. In some embodiments, the tubular string 102 may be a casing string used to line the inner wall of a wellbore drilled into a subterranean formation. In other embodiments, the tubular string 102 may be a work string extended downhole within the wellbore or the casing that lines the wellbore. In either case, the deflector assembly 100 may be generally arranged within a parent or main bore 104 at or otherwise uphole from a junction 106 where a lateral bore 108 extends from the main bore 104. The lateral bore 108 may extend into a lateral wellbore (not shown) drilled at an angle away from the parent or main bore 104.

The deflector assembly 100 may include a first or upper deflector 110*a* and a second or lower deflector 110*b*. In some embodiments, the upper and lower deflectors 110*a,b* may be secured within the tubular string 102 using one or more mechanical fasteners (not shown) and the like. In other embodiments, the upper and lower deflectors 110*a,b* may be welded into place within the tubular string 102, without departing from the scope of the disclosure. In yet other embodiments, the upper and lower deflectors 110*a,b* may form an integral part of the tubular string 102, such as being machined out of bar stock and threaded into the tubular string 102. The upper deflector 110*a* may be arranged closer to the surface (not shown) than the lower deflector 110*b*, and the lower deflector 110*b* may be generally arranged at or adjacent the junction 106.

The upper deflector 110*a* may define or otherwise provide a ramped surface 112 facing toward the uphole direction within the main bore 104. The upper deflector 110*a* may further define a first channel 114*a* and a second channel 114*b*, where both the first and second channels 114*a,b* extend longitudinally through the upper deflector 110*a*. The lower deflector 110*b* may define a first conduit 116*a* and a second conduit 116*b*, where both the first and second conduits 116*a,b* extend longitudinally through the lower deflector 110*b*. The second conduit 116*b* extends into and otherwise communicates with the lateral bore 108 while the first conduit 116*a* extends downhole and otherwise communicates with a lower or downhole portion of the parent or main bore 104 past the junction 106. Accordingly, in at least one embodiment, the deflector assembly 100 may be arranged in a multilateral wellbore system where the lateral bore 108 is only one of several lateral bores that are accessible from the main bore 104 via a corresponding number of deflector assemblies 100 arranged at multiple junctions.

The deflector assembly 100 may be useful in directing a bullnose assembly (not shown) into the lateral bore 108 via the second conduit 116*b* based on a length of the bullnose assembly. If the length of the bullnose assembly does not meet particular length requirements or parameters, it will instead be directed further downhole in the main bore 104 via the first conduit 116*a*. For example, with reference to FIG. 2, the upper deflector 110*a* may be separated from the lower deflector 110*b* within the main bore 104 by a distance 202. The distance 202 may be a predetermined distance that allows a bullnose assembly that is as long as or longer than the distance 202 to be directed into the lateral bore 108 via the second conduit 116*b*. If the length of the bullnose assembly is shorter than the distance 202, however, the bullnose assembly will remain in the main bore 104 and be directed further downhole via the first conduit 116*a*.

Figure 3A:
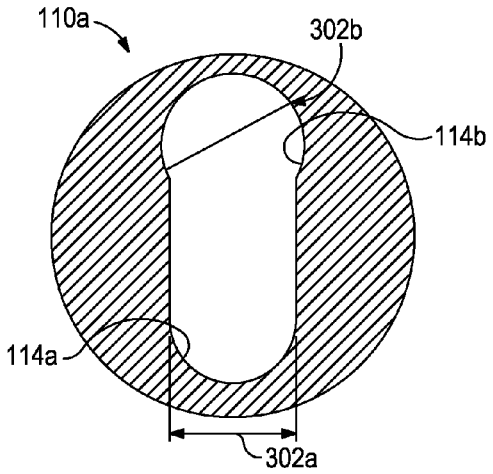
FIGS. 3A and 3B illustrate cross-sectional end views of upper and lower deflectors, respectively, of the deflector assembly of FIG. 1, according to one or more embodiments.
Figure 3B:
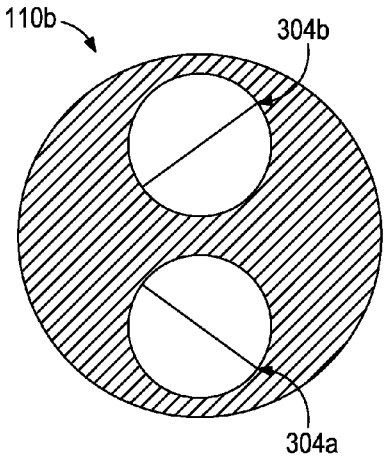

Referring now to FIGS. 3A and 3B, with continued reference to FIGS. 1 and 2, illustrated are cross-sectional end views of the upper and lower deflectors 110*a,b*, respectively, according to one or more embodiments. In FIG. 3A, the first channel 114*a* and the second channel 114*b* are shown as extending longitudinally through the upper deflector 110*a*. The first channel 114*a* may exhibit a first width 302*a* and the second channel 114*b* may exhibit a second width 302*b*, where the second width 302*b* is also equivalent to a diameter of the second channel 114*b*.

As depicted, the first width 302*a* is less than the second width 302*b*. As a result, bullnose assemblies exhibiting a diameter larger than the first width 302*a* but smaller than the second width 302*b* may be able to extend through the upper deflector 110*a* via the second channel 114*b* and otherwise bypass the first channel 114*a*. In such embodiments, the ramped surface 112 (FIGS. 1 and 2) may slidingly engage the bullnose assembly and otherwise direct it to the second channel 114*b*. Alternatively, bullnose assemblies exhibiting a diameter smaller than the first width 302*a* may be able to pass through the upper deflector 110*a* via the first channel 114*a*.

In FIG. 3B, the first and second conduits 116*a,b* are shown as extending longitudinally through the lower deflector 110*b*. While shown in FIG. 3B as being separate from each other, in some embodiments the conduits 116*a,b* may overlap with each other a short distance, without departing from the scope of the disclosure. The first conduit 116*a* may exhibit a first diameter 304*a* and the second conduit 116*b* may exhibit a second diameter 304*b*. In some embodiments, the first and second diameters 304*a,b* may be the same or substantially the same. In other embodiments, the first and second diameters 304*a,b* may be different. In either case, the first and second diameters 304*a,b* may be large enough and otherwise configured to receive a bullnose assembly therethrough after the bullnose assembly has passed through the upper deflector 110*a* (FIG. 3A).

Figure 4A:
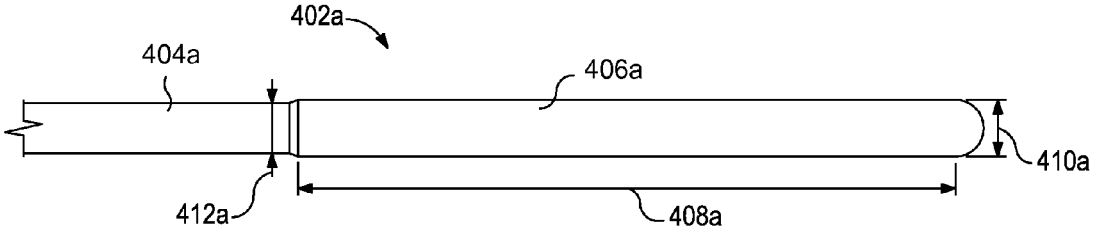
FIGS. 4A and 4B depict exemplary first and second bullnose assemblies, respectively, according to one or more embodiments.
Figure 4B:
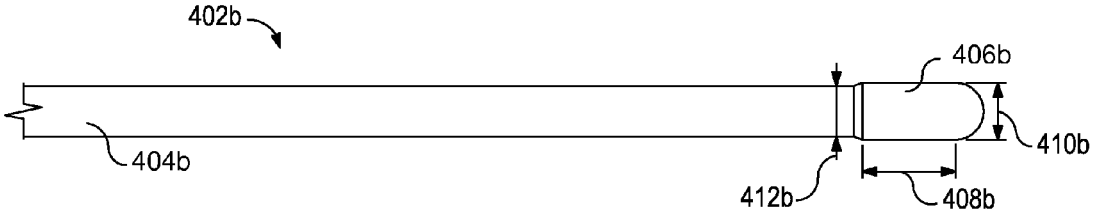

Referring now to FIGS. 4A and 4B, illustrated are exemplary first and second bullnose assemblies 402*a* and 402*b*, respectively, according to one or more embodiments. The bullnose assemblies 402*a,b* may constitute the distal end of a tool string (not shown), such as a bottom hole assembly or the like, that is conveyed downhole within the main wellbore 104 (FIGS. 1-2). In some embodiments, the bullnose assemblies 402*a,b* and related tool strings are conveyed downhole using coiled tubing (not shown). In other embodiments, the bullnose assemblies 402*a,b* and related tool strings may be conveyed downhole using other types of conveyances such as, but not limited to, drill pipe, production tubulars, wireline, slickline, electric line, etc. The tool string may include various downhole tools and devices configured to perform or otherwise undertake various wellbore operations once accurately placed in the downhole environment. The bullnose assemblies 402*a,b* may be configured to accurately guide the tool string downhole such that it reaches its target destination, e.g., the lateral bore 108 of FIGS. 1-2 or further downhole within the main bore 104.

To accomplish this, each bullnose assembly 402*a,b* may include a body 404*a* and 404*b*, respectively, and a bullnose tip 406*a* and 406*b*, respectively, coupled or otherwise attached to the distal end of the body 404*a,b*. In some embodiments, the bullnose tip 406*a,b* may form an integral part of the body 404*a,b* as an integral extension thereof. As illustrated, the bullnose tip 406*a,b* may be rounded off at its end or otherwise angled or arcuate such that the bullnose tip 406*a,b* does not present sharp corners or angled edges that might catch on portions of the main bore 104 as it is extended downhole.

The bullnose tip 406*a* of the first bullnose assembly 402*a* exhibits a first length 408*a* and the bullnose tip 406*b* of the second bullnose assembly 402*b* exhibits a second length 408*b*. As depicted, the first length 408*a* is greater than the second length 408*b*. Moreover, the bullnose tip 406*a* of the first bullnose assembly 402*a* exhibits a first diameter 410*a* and the bullnose tip 406*b* of the second bullnose assembly 402*b* exhibits a second diameter 410*b*. In some embodiments, the first and second diameters 410*a,b* may be the same or substantially the same. In other embodiments, the first and second diameters 410*a,b* may be different. In either case, the first and second diameters 410*a,b* may be small enough and otherwise able to extend through the second width 302*b* (FIG. 3A) of the upper deflector 110*a* and the first and second diameters 304*a,b* (FIG. 3B) of the lower deflector 110*b*.

Still referring to FIGS. 4A and 4B, the body 404*a* of the first bullnose assembly 402*a* exhibits a third diameter 412*a* and the body 404*b* of the second bullnose assembly 402*b* exhibits a fourth diameter 412*b*. In some embodiments, the third and fourth diameters 412*a,b* may be the same or substantially the same. In other embodiments, the third and fourth diameters 412*a,b* may be different. In either case, the third and fourth diameters 412*a,b* may be smaller than the first and second diameters 410*a,b*. Moreover, the third and fourth diameters 412*a,b* may be smaller than the first width 302*a* (FIG. 3A) of the upper deflector 110*a* and otherwise able to be received therein, as will be discussed in greater detail below.

Figure 5A:
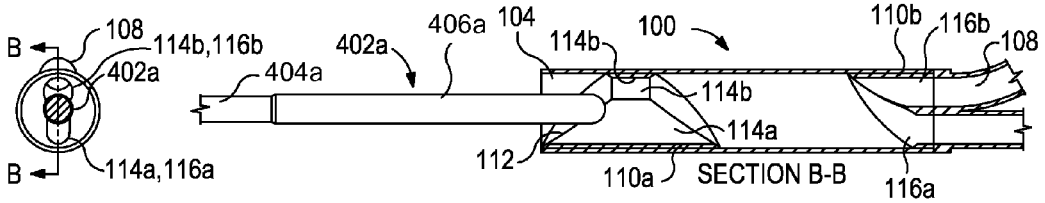
FIGS. 5A-5C illustrate cross-sectional progressive views of the deflector assembly of FIGS. 1 and 2 in exemplary operation with bullnose assembly of FIG. 4A, according to one or more embodiments.
Figure 5B:
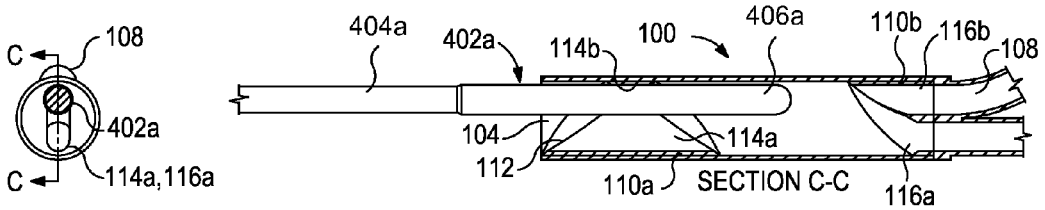
Figure 5C:
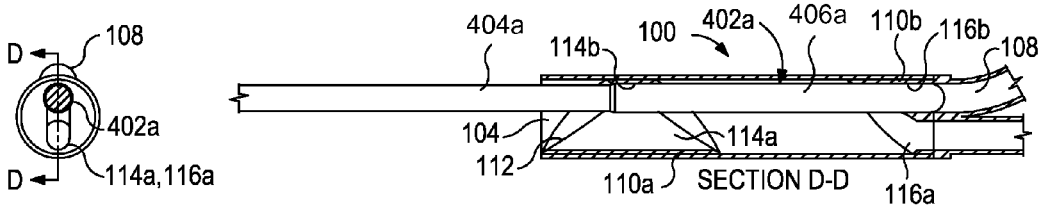

Referring now to FIGS. 5A-5C, with continued reference to the preceding figures, illustrated are cross-sectional views of the deflector assembly 100 as used in exemplary operation, according to one or more embodiments. More particularly, FIGS. 5A-5C illustrate progressive views of the first bullnose assembly 402*a* of FIG. 4A interacting with and otherwise being deflected by the deflector assembly 100 based on the parameters of the first bullnose assembly 402*a*. Furthermore, each of FIGS. 5A-5C provides a cross-sectional end view (on the left of each figure) and a corresponding cross-sectional side view (on the right of each figure) of the exemplary operation as it progresses.

In FIG. 5A, the first bullnose assembly 402*a* is extended downhole within the main bore 104 and engages the upper deflector 110*a*. More specifically, the diameter 410*a* (FIG. 4A) of the bullnose tip 406*a* may be larger than the first width 302*a* (FIG. 3A) such that the bullnose tip 406*a* is unable to extend through the upper deflector 110*a* via the first channel 114*a*. Instead, the bullnose tip 406*a* may be configured to slidingly engage the ramped surface 112 until locating the second channel 114*b*. Since the diameter 410*a* (FIG. 4A) of the bullnose tip 406*a* is smaller than the second width 302*b* (FIG. 3A), the bullnose assembly 402*a* is able to extend through the upper deflector 110*a* via the second channel 114*b*. This is shown in FIG. 5B as the bullnose assembly 402*a* is advanced in the main bore 104 and otherwise extended at least partially through the upper deflector 110*a*.

In FIG. 5C, the bullnose assembly 402*a* is advanced further in the main bore 104 and directed into the second conduit 116*b* of the lower deflector 110*b*. This is possible since the length 408*a* (FIG. 4A) of the bullnose tip 406*a* is greater than the distance 202 (FIG. 2) that separates the upper and lower deflectors 110*a,b*. In other words, since the distance 202 is less than the length 408*a* of the bullnose tip 406*a*, the bullnose assembly 402*a* is generally prevented from moving laterally within the main bore 104 and toward the first conduit 116*a* of the lower deflector 110*b*. Rather, the bullnose tip 406*a* is received by the second conduit 116*b* while at least a portion of the bullnose tip 406*a* remains supported in the second channel 114*b* of the upper deflector 110*a*. Moreover, the second conduit 116*b* exhibits a diameter 304*b* (FIG. 3B) that is greater than the diameter 410*a* (FIG. 4A) of the bullnose tip 406*a* and can therefore guide the bullnose assembly 402*a* toward the lateral bore 108.

Referring now to FIGS. 6A-6D, with continued reference to the preceding figures, illustrated are cross-sectional views of the deflector assembly 100 as used in exemplary operation, according to one or more embodiments. More particularly, FIGS. 6A-6D illustrate progressive views of the second bullnose assembly 402*b* interacting with and otherwise being deflected by the deflector assembly 100. Furthermore, similar to FIGS. 5A-5C, each of FIGS. 6A-6D provides a cross-sectional end view (on the left of each figure) and a corresponding cross-sectional side view (on the right of each figure) of the exemplary operation as it progresses.

Figure 6A:
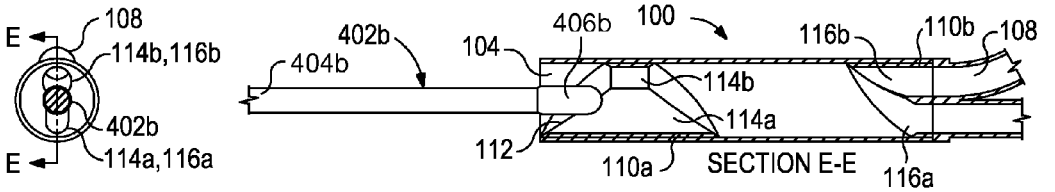
FIGS. 6A-6D illustrate cross-sectional progressive views of the deflector assembly of FIGS. 1 and 2 in exemplary operation with bullnose assembly of FIG. 4B, according to one or more embodiments.
Figure 6B:
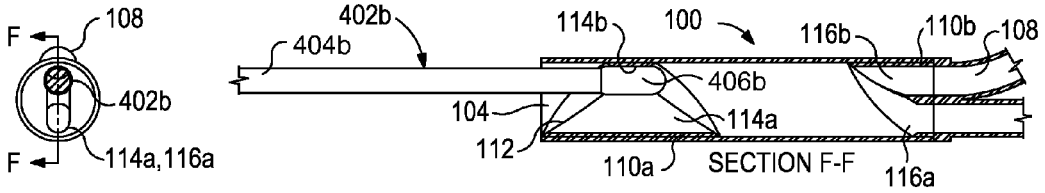

In FIG. 6A, the second bullnose assembly 402*b* is shown engaging the upper deflector 110*a* after having been extended downhole within the main bore 104. More specifically, and similar to the first bullnose assembly 402*a*, the diameter 410*b* (FIG. 4B) of the bullnose tip 406*b* may be larger than the first width 302*a* (FIG. 3A) such that the bullnose tip 406*b* is unable to extend through the upper deflector 110*a* via the first channel 114*a*. Instead, the bullnose tip 406*b* may be configured to slidingly engage the ramped surface 112 until locating the second channel 114*b*. Since the diameter 410*b* (FIG. 4B) of the bullnose tip 406*b* is smaller than the second width 302*b* (FIG. 3A), the bullnose assembly 402*b* may be able to extend through the upper deflector 110*a* via the second channel 114*b*. This is shown in FIG. 6B as the bullnose assembly 402*b* is advanced in the main bore 104 and otherwise extended at least partially through the upper deflector 110*a*.

Figure 6C:
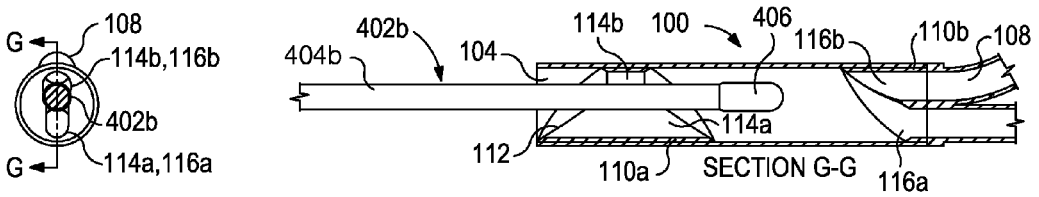

In FIG. 6C, the bullnose assembly 402*b* is advanced further in the main bore 104 until the bullnose tip 406*b* exits the second channel 114*b*. Upon the exit of the bullnose tip 406*b* from the second channel 114*b*, the bullnose assembly 402*b* may no longer be supported within the second channel 114*b* and may instead fall into or otherwise be received by the first channel 114*a*. This is possible since the diameter 412*b* (FIG. 4B) of the body 404*b* of the bullnose assembly 402*b* is smaller than the first width 302*a* (FIG. 3A), and the length 408*b* (FIG. 4B) of the bullnose tip 406*b* is less than the distance 202 (FIG. 2) that separates the upper and lower deflectors 110*a,b*. Accordingly, gravity may act on the bullnose assembly 402*b* and allow it to fall into the first channel 114*a* once the bullnose tip 406*b* exits the second channel 114*b* and no longer supports the bullnose assembly 402*b*.

Figure 6D:
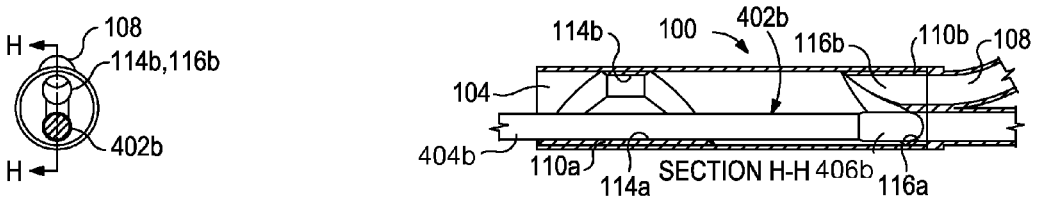

In FIG. 6D, the bullnose assembly 402*b* is advanced even further in the main bore 104 until the bullnose tip 406*b* enters or is otherwise received within the first conduit 116*a*. The first conduit 116*a* exhibits a diameter 304*a* (FIG. 3B) that is greater than the diameter 410*b* (FIG. 4B) of the bullnose tip 406*b* and can therefore guide the bullnose assembly 402*b* further down the main bore 104 and otherwise not into the lateral bore 108.

Accordingly, which bore (e.g., the main bore 104 or the lateral bore 108) a bullnose assembly enters is primarily determined by the relationship between the length 408*a*, 408*b* of the bullnose tip 406*b* and the distance 202 between the upper and lower deflectors 110*a,b*. As a result, it becomes possible to "stack" multiple junctions 106 (FIGS. 1 and 2) in one well and thereby facilitate re-entry into every lateral bore of the well by predetermining the spacing (i.e., distance 202) between the deflectors 110*a,b* at each junction 106 and selecting the appropriate bullnose assembly for the desired lateral bore.

Figure 7:
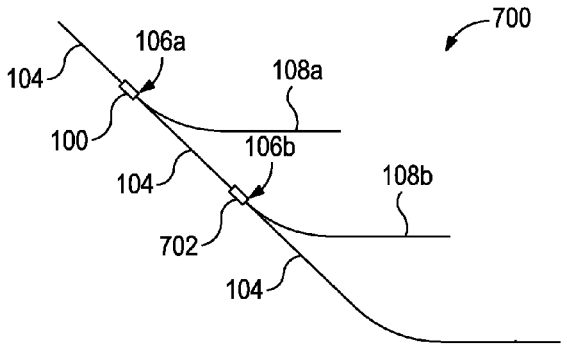
FIG. 7 illustrates an exemplary multilateral wellbore system that may implement the principles of the present disclosure.

Referring to FIG. 7, illustrated is an exemplary multilateral wellbore system 700 that may implement the principles of the present disclosure. The wellbore system 700 may include a main bore 104 that extends from a surface location (not shown) and passes through at least two junctions 106 (shown as a first junction 106*a* and a second junction 106*b*). While two junctions 106*a,b* are shown in the wellbore system 700, it will be appreciated that more than two junctions 106*a,b* may be utilized, without departing from the scope of the disclosure. At each junction 106*a,b*, a lateral bore 108 (shown as first and second lateral bores 108*a* and 108*b*, respectively) extends from the main bore 104.

The deflector assembly 100 of FIGS. 1 and 2 may be arranged at the first junction 106*a* and a second deflector assembly 702 may be arranged at the second junction 106*b*. Each deflector assembly 100, 702 may be configured to deflect a bullnose assembly either into its corresponding lateral bore 108*a,b* or further downhole within the main bore 104, depending on the length of the bullnose tip of a particular bullnose assembly and the spacing between the upper and lower deflectors of the particular deflector assembly 100, 702.

Figure 8:
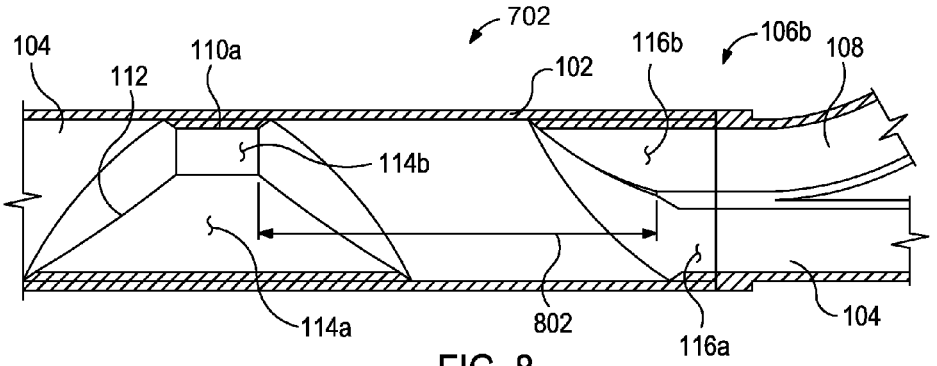
FIG. 8 illustrates a cross-sectional side view of another deflector assembly of FIG. 1, according to one or more embodiments.

Referring to FIG. 8, with continued reference to FIGS. 2 and 7, illustrated is a cross-sectional side view of the second deflector assembly 702, according to one or more embodiments. The second deflector assembly 702 may be similar in some respects to the deflector assembly 100 of FIGS. 1 and 2 (and now FIG. 7) and therefore may be best understood with reference thereto, where like numerals represent like elements not described again in detail. In the second deflector assembly 702, the upper deflector 110*a* may be separated from the lower deflector 110*b* within the main bore 104 by a distance 802. The distance 802 may be less than the distance 202 in the first deflector assembly 100 of FIG. 2.

Accordingly, the first and second deflector assemblies 100, 702 may be configured to deflect bullnose assemblies into different lateral bores 108*a,b* based on the length of the bullnose tip. If a bullnose tip is as long as or longer than the distances 202 and 802, the corresponding bullnose assembly will be directed into the respective lateral bore 108*a,b*. If, however, the length of the bullnose tip is shorter than the distances 202 and 802, the bullnose assembly will remain in the main bore 104 and be directed further downhole.

Figure 9:
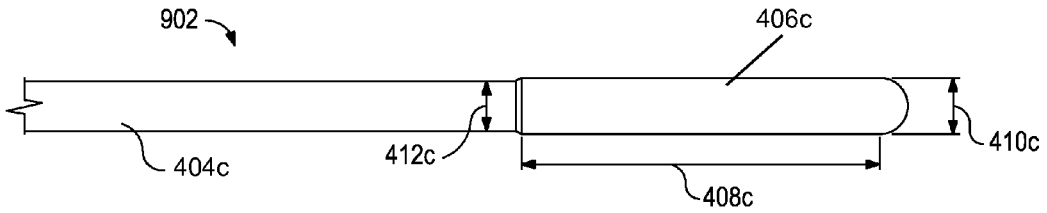
FIG. 9 illustrates another exemplary bullnose assembly, according to one or more embodiments

Referring now to FIG. 9, with additional reference to FIGS. 4A and 4B, illustrated is another exemplary bullnose assembly 902, according to one or more embodiments. The bullnose assembly 902 may be substantially similar to the bullnose assemblies 402*a,b* of FIGS. 4A and 4B and therefore may be best understood with reference thereto, where like numerals correspond to like elements not described again. Similar to the bullnose assemblies 402*a,b*, of FIGS. 4A and 4B, the bullnose assembly 902 may include a body 404*c* and a bullnose tip 406*c* coupled to or otherwise forming an integral part of the distal end of the body 404*c*. The bullnose tip 406 of the bullnose assembly 902, however, exhibits a third length 408*c* that is shorter than the first length 408*a* (FIG. 4A) but longer than the second length 408*b* (FIG. 4B). Moreover, the bullnose tip 406 of the bullnose assembly 902 exhibits a fifth diameter 410*c* that may be the same as or different than the first and second diameters 410*a,b* (FIGS. 4A and 4B). In any event, the fifth diameter 410*c* may be small enough and otherwise able to extend through the second width 302*b* (FIG. 3A) of the upper deflector 110*a* and the first and second diameters 304*a,b* (FIG. 3B) of the lower deflector 110*b* of either the first or second deflector assemblies 100, 702. Lastly, the body 404 of the bullnose assembly 902 exhibits a sixth diameter 412*c* that may be the same as or different than the third and fourth diameters 412*a,b* (FIGS. 4A and 4B). In any event, the sixth diameter 412*c* may be smaller than the first, second, and third diameters 410*a-c* and also smaller than the first width 302*a* (FIG. 3A) of the upper deflector 110*a* (of either the first or second deflector assemblies 100, 702) and otherwise able to be received therein.

The bullnose tip 406*c* of the bullnose assembly 902, however, exhibits a third length 408*c* that is shorter than the first length 408*a* (FIG. 4A) but longer than the second length 408*b* (FIG. 4B). Moreover, the bullnose tip 406*c* of the bullnose assembly 902 exhibits a fifth diameter 410*c* that may be the same as or different than the first and second diameters 410*a,b* (FIGS. 4A and 4B). In any event, the fifth diameter 410*c* may be small enough and otherwise able to extend through the second width 302*b* (FIG. 3A) of the upper deflector 110*a* and the first and second diameters 304*a,b* (FIG. 3B) of the lower deflector 110*b* of either the first or second deflector assemblies 100, 702. Lastly, the body 404*c* of the bullnose assembly 902 exhibits a sixth diameter 412*c* that may be the same as or different than the third and fourth diameters 412*a,b* (FIGS. 4A and 4B). In any event, the sixth diameter 412*c* may be smaller than the first, second, and third diameters 410*a-c* and also smaller than the first width 302*a* (FIG. 3A) of the upper deflector 110*a* (of either the first or second deflector assemblies 100, 702) and otherwise able to be received therein.

Figure 10A:
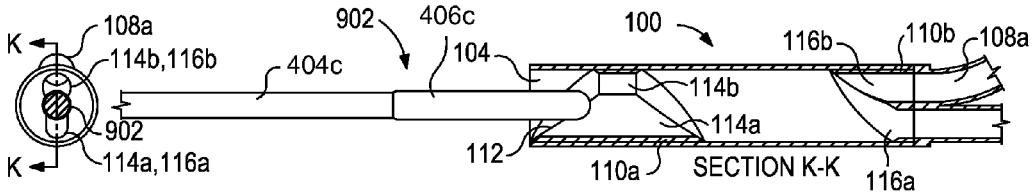
FIGS. 10A-10D illustrate cross-sectional progressive views of the deflector assembly of FIGS. 1 and 2 in exemplary operation with the bullnose assembly of FIG. 9, according to one or more embodiments.
Figure 10B:
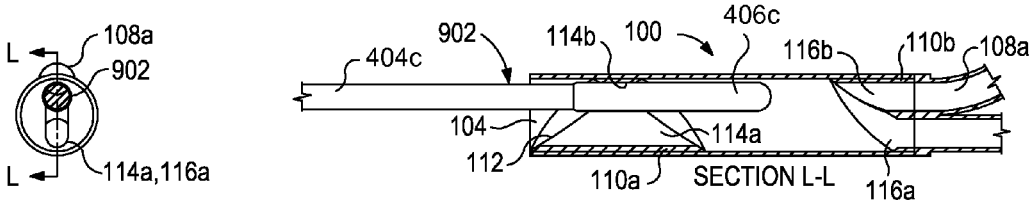

More particularly, FIGS. 10A-10D illustrate progressive views of the bullnose assembly 902 interacting with and otherwise being deflected by the deflector assembly 100 based on the parameters of the bullnose assembly 902. In FIG. 10A, the bullnose assembly 902 is shown engaging the upper deflector 110*a* after having been extended downhole within the main bore 104. The diameter 410*c* (FIG. 9) of the bullnose tip 406*c* may be larger than the first width 302*a* (FIG. 3A) such that the bullnose tip 406*c* is unable to extend through the upper deflector 110*a* via the first channel 114*a*. Instead, the bullnose tip 406*c* may be configured to slidingly engage the ramped surface 112 until locating the second channel 114*b*. Since the diameter 410*c* (FIG. 9) of the bullnose tip 406*c* is smaller than the second width 302*b* (FIG. 3A), the bullnose assembly 902 may be able to extend through the upper deflector 110*a* via the second channel 114*b*. This is shown in FIG. 10B as the bullnose assembly 902 is advanced in the main bore 104 and otherwise extended at least partially through the upper deflector 110*a*.

Figure 10C:
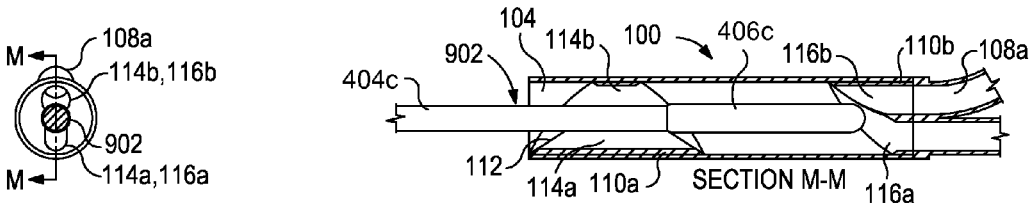

In FIG. 10C, the bullnose assembly 902 is advanced further in the main bore 104 until the bullnose tip 406*c* exits the second channel 114*b*. Upon the exit of the bullnose tip 406*c* from the second channel 114*b*, the bullnose assembly 902 may no longer be supported within the second channel 114*b* and may instead fall into or otherwise be received by the first channel 114*a*. This is possible since the diameter 412*c* (FIG. 9) of the body 404*c* of the bullnose assembly 902 is smaller than the first width 302*a* (FIG. 3A), and the length 408*c* (FIG. 9) of the bullnose tip 406*c* is less than the distance 202 (FIG. 2) that separates the upper and lower deflectors 110*a,b*. Accordingly, gravity may act on the bullnose assembly 902 and allow it to fall into the first channel 114*a* once the bullnose tip 406*c* exits the second channel 114*b* and no longer supports the bullnose assembly 902.

Figure 10D:
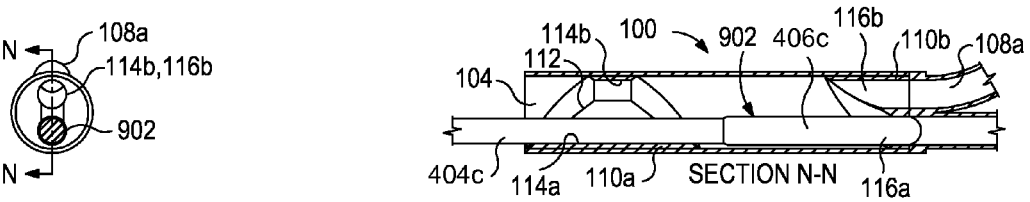

In FIG. 10D, the bullnose assembly 902 is advanced even further in the main bore 104 until the bullnose tip 406*c* enters or is otherwise received within the first conduit 116*a*. The first conduit 116*a* exhibits a diameter 304*a* (FIG. 3B) that is greater than the diameter 410*c* (FIG. 9) of the bullnose tip 406*c* and can therefore guide the bullnose assembly 902 further down the main bore 104 and otherwise not into the first lateral bore 108*a*.

Figure 11A:
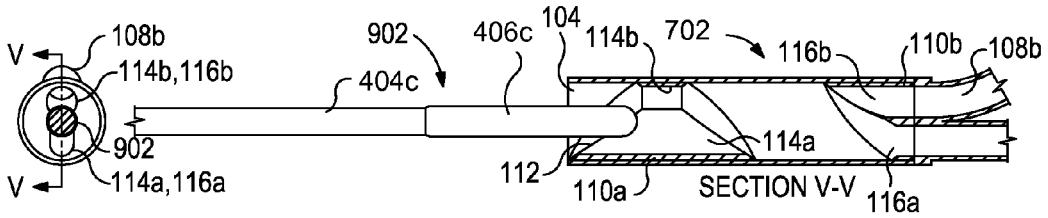
FIGS. 11A-11C illustrate cross-sectional views of the deflector assembly of FIG. 8 in exemplary operation with the bullnose assembly of FIG. 9, according to one or more embodiments.
Figure 11B:
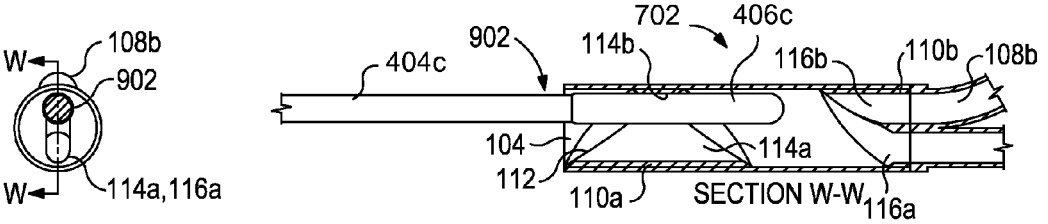
Figure 11C:
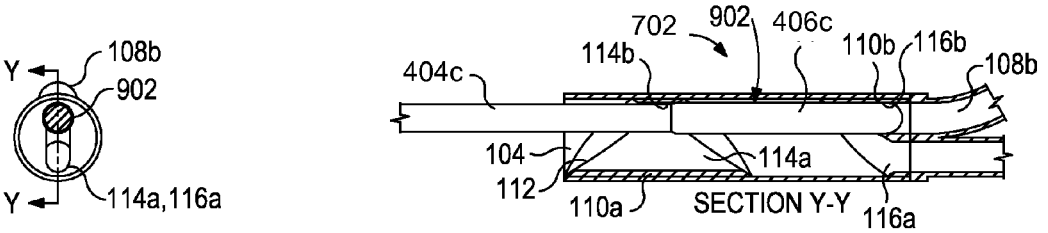

Referring now to FIGS. 11A-11C, with continued reference to FIGS. 10A-10D, illustrated are cross-sectional views of the second deflector assembly 702 as used in exemplary operation with the third bullnose assembly 902 following passage through the first deflector assembly 100. More particularly, FIGS. 11A-11C depict the third bullnose assembly 902 after having passed through the first deflector assembly 100 in the multilateral wellbore system 700 of FIG. 7 and is now advanced further within the main bore 104 until interacting with and otherwise being deflected by the second deflector assembly 702.

In FIG. 11A, the third bullnose assembly 902 is extended downhole within the main bore 104 and engages the upper deflector 110*a* of the second deflector assembly 702. The diameter 410*c* (FIG. 9) of the bullnose tip 406*c* may be larger than the first width 302*a* (FIG. 3A) such that the bullnose tip 406*c* is unable to extend through the upper deflector 110*a* via the first channel 114*a*. Instead, the bullnose tip 406*c* may be configured to slidingly engage the ramped surface 112 until locating the second channel 114*b*. Since the diameter 410*c* (FIG. 9) of the bullnose tip 406*c* is smaller than the second width 302*b* (FIG. 3A), the bullnose assembly 902 is able to extend through the upper deflector 110*a* via the second channel 114*b*. This is shown in FIG. 11B as the bullnose assembly 902 is advanced in the main bore 104 and otherwise extended at least partially through the upper deflector 110*a*.

In FIG. 11C, the bullnose assembly 902 is advanced further in the main bore 104 and directed into the second conduit 116*b* of the lower deflector 110*b*. This is possible since the length 408*c* (FIG. 9) of the bullnose tip 406*c* is greater than the distance 802 (FIG. 7) that separates the upper and lower deflectors 110*a,b* of the second deflector assembly 702. In other words, since the distance 802 is less than the length 408*c* of the bullnose tip 406*c*, the bullnose assembly 902 is generally prevented from moving laterally within the main bore 104 and toward the first conduit 116*a* of the lower deflector

110*b*. Rather, the bullnose tip 406*c* is received by the second conduit 116*b* while at least a portion of the bullnose tip 406*c* remains supported in the second channel 114*b* of the upper deflector 110*a*. Moreover, the second conduit 116*b* exhibits a diameter 304*b* (FIG. 3B) that is greater than the diameter 410*c* (FIG. 9) of the bullnose tip 406*c* and can therefore guide the bullnose assembly 902 toward the second lateral bore 108*b*.

Embodiments disclosed herein include:

A. A deflector assembly that includes an upper deflector arranged within a main bore of a wellbore and defining first and second channels that extend longitudinally through the upper deflector, wherein the second channel exhibits a width greater than a width of the first channel, and a lower deflector arranged within the main bore and spaced from the upper deflector by a predetermined distance, the lower deflector defining a first conduit that communicates with a lower portion of the main bore and a second conduit that communicates with a lateral bore, wherein the upper and lower deflectors are configured to direct a bullnose assembly into either the lateral bore or the lower portion of the main bore based on a length of a bullnose tip of the bullnose assembly as compared to the predetermined distance.

B. A method including introducing a bullnose assembly into a main bore of a wellbore, the bullnose assembly including a body and a bullnose tip arranged at a distal end of the body and exhibiting a length, directing the bullnose assembly through an upper deflector arranged within the main bore, the upper deflector defining first and second channels that extend longitudinally therethrough, wherein the second channel exhibits a width greater than a width of the first channel, advancing the bullnose assembly to a lower deflector arranged within the main bore and spaced from the upper deflector by a predetermined distance, the lower deflector defining a first conduit that communicates with a lower portion of the main bore and a second conduit that communicates with a lateral bore, and directing the bullnose assembly into either the lateral bore or the lower portion of the main bore based on the length of the bullnose tip as compared to the predetermined distance.

C. A multilateral wellbore system including a main bore having a first junction and a second junction spaced downhole form the first junction, a first deflector assembly arranged at the first junction and comprising a first upper deflector and a first lower deflector spaced from the first upper deflector by a first predetermined distance, the first lower deflector defining a first conduit that communicates with a first lower portion of the main bore and a second conduit that communicates with a first lateral bore, a second deflector assembly arranged at the second junction and comprising a second upper deflector and a second lower deflector spaced from the second upper deflector by a second predetermined distance that is shorter than the first predetermined distance, the second lower deflector defining a third conduit that communicates with a second lower portion of the main bore and a fourth conduit that communicates with a second lateral bore, and a bullnose assembly including a body and a bullnose tip arranged at a distal end of the body and exhibiting a length, wherein the first and second deflector assemblies are configured to direct the bullnose assembly into either the first and second lateral bores or the first and second lower portions of the main bore based on the length of the bullnose tip as compared to the first and second predetermined distances.

Each of embodiments A, B, and C may have one or more of the following additional elements in any combination: Element 1: wherein the upper and lower deflectors are arranged within a tubular string that extends from a surface location. Element 2: wherein the upper deflector provides a ramped surface facing toward an uphole direction within the main bore, the ramped surface being configured to direct the bullnose assembly into the second channel. Element 3: wherein the bullnose tip is coupled to a distal end of a body of the bullnose assembly, the bullnose tip exhibiting a first diameter and the body exhibiting a second diameter smaller than the first diameter and also smaller than the width of the first channel. Element 4: wherein, when the length of the bullnose tip is less than the predetermined distance, the body is configured to be received within the first channel and the bullnose assembly is directed into the first conduit. Element 5: wherein, when the length of the bullnose tip is greater than the predetermined distance, the bullnose assembly is configured to be directed into the second conduit and the lateral bore. Element 6: wherein, when the length of the bullnose tip is less than the predetermined distance, the bullnose assembly is configured to be directed into the first conduit and the lower portion of the main bore.

Element 7: wherein directing the bullnose assembly through the upper deflector includes engaging the bullnose tip on a ramped surface defined by the upper deflector, and directing the bullnose tip into and through the second channel with the ramped surface. Element 8: wherein the bullnose tip exhibits a first diameter and the body exhibits a second diameter smaller than the first diameter and also smaller than the width of the first channel, the method further including receiving the body within the first channel when the length of the bullnose tip is less than the predetermined distance, and directing the bullnose assembly into the first conduit. Element 9: further comprising directing the bullnose assembly into the second conduit and the lateral bore when the length of the bullnose tip is greater than the predetermined distance. Element 10: further comprising directing the bullnose assembly into the first conduit and the lower portion of the main bore when the length of the bullnose tip is less than the predetermined distance.

Element 11: wherein, when the length of the bullnose tip is shorter than the first predetermined distance but greater than the second predetermined distance, the bullnose assembly is directed into the first conduit and the first lower portion of the main bore and subsequently into the fourth conduit and the second lateral bore. Element 12: wherein, when the length of the bullnose tip is shorter than the first and second predetermined distances, the bullnose assembly is directed into the first conduit and the first lower portion of the main bore and subsequently into the third conduit and the second lower portion of the main bore. Element 13: wherein, when the length of the bullnose tip is greater than the first predetermined distance, the bullnose assembly is directed into the second conduit and the first lateral bore. Element 14: wherein the first and second upper deflectors each define first and second channels that extend longitudinally through the corresponding first and second upper deflectors, and wherein the second channel exhibits a width greater than a width of the first channel. Element 15: wherein the bullnose tip exhibits a first diameter and the body exhibits a second diameter smaller than the first diameter and smaller than the width of the first channel of the first upper deflector, and wherein, when the length of the bullnose tip is less than the first predetermined distance, the body is received within the first channel of the first upper deflector and the bullnose assembly is directed into the first conduit of the first lower deflector. Element 16: wherein the bullnose tip exhibits a first diameter and the body exhibits a second diameter smaller than the first diameter and smaller than the width of the first channel of the second upper deflector, and wherein, when the length of the bullnose tip is less than the second predetermined distance, the body is received within the first channel of the second upper deflector and the bullnose assembly is directed into the third conduit of the second lower deflector.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A wellbore system, comprising:

an upper deflector arranged within a main bore of a wellbore and defining first and second channels that extend longitudinally through the upper deflector, wherein the second channel exhibits a width greater than a width of the first channel;

a lower deflector arranged within the main bore and axially spaced from the upper deflector by a predetermined distance, the lower deflector defining a first conduit that communicates with a lower portion of the main bore and a second conduit that communicates with a lateral bore; and a bullnose assembly including a body and a bullnose tip arranged at a distal end of the body, wherein the upper and lower deflectors direct the bullnose assembly into either the lateral bore or the lower portion of the main bore based on a length of the bullnose tip as compared to the predetermined distance.

2. The wellbore system of claim 1, wherein the upper and lower deflectors are arranged within a tubular string that extends from a surface location.

3. The wellbore system of claim 1, wherein the upper deflector provides a ramped surface facing toward an uphole direction within the main bore, the ramped surface being configured to direct the bullnose assembly into the second channel.

4. The wellbore system of claim 1, wherein the bullnose tip is coupled to a distal end of a body of the bullnose assembly, the bullnose tip exhibiting a first diameter and the body exhibiting a second diameter smaller than the first diameter and also smaller than the width of the first channel.

5. The wellbore system of claim 4, wherein the length of the bullnose tip is less than the predetermined distance and the body is configured to be received within the first channel and the bullnose assembly is directed into the first conduit.

6. The wellbore system of claim 1, wherein the length of the bullnose tip is greater than the predetermined distance and the bullnose assembly is configured to be directed into the second conduit and the lateral bore.

7. The wellbore system of claim 1, wherein the length of the bullnose tip is less than the predetermined distance and the bullnose assembly is configured to be directed into the first conduit and the lower portion of the main bore.

8. A method, comprising:

introducing a bullnose assembly into a main bore of a wellbore, the bullnose assembly including a body and a bullnose tip arranged at a distal end of the body and exhibiting a length;

directing the bullnose assembly through an upper deflector arranged within the main bore, the upper deflector defining first and second channels that extend longitudinally therethrough, wherein the second channel exhibits a width greater than a width of the first channel;

advancing the bullnose assembly to a lower deflector arranged within the main bore and spaced from the upper deflector by a predetermined distance, the lower deflector defining a first conduit that communicates with a lower portion of the main bore and a second conduit that communicates with a lateral bore; and directing the bullnose assembly into either the lateral bore or the lower portion of the main bore based on the length of the bullnose tip as compared to the predetermined distance.

9. The method of claim 8, wherein directing the bullnose assembly through the upper deflector comprises:

engaging the bullnose tip on a ramped surface defined by the upper deflector; and directing the bullnose tip into and through the second channel with the ramped surface.

10. The method of claim 8, wherein the bullnose tip exhibits a first diameter and the body exhibits a second diameter smaller than the first diameter and also smaller than the width of the first channel, the method further comprising:

receiving the body within the first channel with the length of the bullnose tip being less than the predetermined distance; and directing the bullnose assembly into the first conduit.

11. The method of claim 8, further comprising directing the bullnose assembly into the second conduit and the lateral bore with the length of the bullnose tip being greater than the predetermined distance.

12. The method of claim 8, further comprising directing the bullnose assembly into the first conduit and the lower portion of the main bore with the length of the bullnose tip being less than the predetermined distance.

13. A multilateral wellbore system, comprising:

a main bore having a first junction and a second junction spaced downhole from the first junction;

a first deflector assembly arranged at the first junction and comprising a first upper deflector and a first lower deflector spaced from the first upper deflector by a first predetermined distance, the first lower deflector defining a first conduit that communicates with a first lower portion of the main bore and a second conduit that communicates with a first lateral bore;

a second deflector assembly arranged at the second junction and comprising a second upper deflector and a second lower deflector spaced from the second upper deflector by a second predetermined distance that is shorter than the first predetermined distance, the second lower deflector defining a third conduit that communicates with a second lower portion of the main bore and a fourth conduit that communicates with a second lateral bore; and a bullnose assembly including a body and a bullnose tip arranged at a distal end of the body and exhibiting a length, wherein the first and second deflector assemblies are configured to direct the bullnose assembly into either the first and second lateral bores or the first and second lower portions of the main bore based on the length of the bullnose tip as compared to the first and second predetermined distances.

14. The multilateral wellbore system of claim 13, wherein the length of the bullnose tip is shorter than the first predetermined distance but greater than the second predetermined distance and the bullnose assembly is directed into the first conduit and the first lower portion of the main bore and subsequently into the fourth conduit and the second lateral bore.

15. The multilateral wellbore system of claim 13, wherein the length of the bullnose tip is shorter than the first and second predetermined distances and the bullnose assembly is directed into the first conduit and the first lower portion of the main bore and subsequently into the third conduit and the second lower portion of the main bore.

16. The multilateral wellbore system of claim 13, wherein the length of the bullnose tip is greater than the first predetermined distance and the bullnose assembly is directed into the second conduit and the first lateral bore.

17. The multilateral wellbore system of claim 13, wherein the first and second upper deflectors each define first and second channels that extend longitudinally through the corresponding first and second upper deflectors, and wherein the second channel exhibits a width greater than a width of the first channel.

18. The multilateral wellbore system of claim 17, wherein the bullnose tip exhibits a first diameter and the body exhibits a second diameter smaller than the first diameter and smaller than the width of the first channel of the first upper deflector, and wherein the length of the bullnose tip is less than the first predetermined distance and the body is received within the first channel of the first upper deflector and the bullnose assembly is directed into the first conduit of the first lower deflector.

19. The multilateral wellbore system of claim 17, wherein the bullnose tip exhibits a first diameter and the body exhibits a second diameter smaller than the first diameter and smaller than the width of the first channel of the second upper deflector, and wherein the length of the bullnose tip is less than the second predetermined distance and the body is received within the first channel of the second upper deflector and the bullnose assembly is directed into the third conduit of the second lower deflector.

* * * * *